United States Patent [19]

Weimar et al.

[11] Patent Number: 5,018,681

[45] Date of Patent: May 28, 1991

[54] ROVING BOBBIN CREEL FOR A TEXTILE RING SPINNING MACHINE OR THE LIKE

[75] Inventors: Michael Weimar, Ebersbach/Fils; Norbert Städele, Göppingen, both of Fed. Rep. of Germany

[73] Assignee: Zinser Textilmaschinen GmbH, Ebersbach/Fils, Fed. Rep. of Germany

[21] Appl. No.: 448,690

[22] Filed: Dec. 11, 1989

[30] Foreign Application Priority Data

Dec. 10, 1988 [DE] Fed. Rep. of Germany ..... 3841652

[51] Int. Cl.[5] ..... B65H 49/14

[52] U.S. Cl. ..... 242/131; 57/281; 211/162; 211/205; 242/130.2; 248/205.1; 248/214; 248/218.4; 248/225.31

[58] Field of Search ..... 242/131, 130.2, 130; 57/281, 75; 248/158, 205.1, 207, 214, 218.4, 219.1, 225.31; 211/123, 124, 162, 189, 205

[56] References Cited

U.S. PATENT DOCUMENTS

| | | | |
|---|---|---|---|
| 2,819,855 | 1/1958 | Hewitt | 242/131 |
| 2,869,903 | 1/1959 | Hewitt | 211/162 |
| 2,880,024 | 3/1959 | Hewitt | 211/162 |
| 2,945,639 | 7/1960 | Bohannon | 242/131 |
| 2,958,479 | 11/1960 | Crawford et al. | 242/131 |
| 3,074,667 | 1/1963 | Keyser | 242/131 |
| 4,564,152 | 1/1986 | Herriage | 242/86.5 R |

FOREIGN PATENT DOCUMENTS

| | | | |
|---|---|---|---|
| 857171 | 11/1952 | Fed. Rep. of Germany . | |
| 1098419 | 1/1961 | Fed. Rep. of Germany . | |
| 3732252 | 4/1988 | Fed. Rep. of Germany . | |
| 617283 | 8/1959 | Italy . | |
| 884099 | 12/1961 | United Kingdom | 242/131 |

*Primary Examiner*—3
*Assistant Examiner*—Stanley N. Gilreath
*Attorney, Agent, or Firm*—Shefte, Pinckney & Sawyer

[57] ABSTRACT

A roving bobbin creel for use in a textile ring spinning machine includes upright stanchions spaced along the length of the machine at its center, mounting elements affixed to the upright stanchions, support elements affixed to the mounting elements to extend transversely outwardly therefrom, and an elongate carrier element affixed to the underside of the support elements to extend longitudinally with respect to the spinning machine for supporting a plurality of roving bobbins in depending fashion from the elongate carrier element. Each mounting element includes a tongue portion projecting transversely outwardly with respect to the spinning machine and each support element defines an interior receiving area for insertion of the tongue portion for simple yet secure affixation of the supporting elements on the mounting elements.

10 Claims, 5 Drawing Sheets

ROVING BOBBIN CREEL FOR A TEXTILE RING SPINNING MACHINE OR THE LIKE

BACKGROUND OF THE INVENTION

The present invention relates to textile roving bobbin creels and, in particular, to such creels utilized in textile ring spinning and like machines, wherein several upright support stanchions are spaced along the length of the machine at its transverse center with mounting elements affixed to the stanchions for mounting outwardly extending support elements to which elongate carrier elements, often configured as profiled support rails, are attached to receive holder elements for supporting textile roving bobbins.

In known roving bobbin creels of the basic above-described type, the outwardly extending support elements may be produced from flat metal stock and fastened by screws or the like onto the upright stanchions, with the elongate carrier elements resting on and being fastened to the upwardly facing surfaces of the support elements. Roving bobbin creels of this type suffice for use in spinning machines wherein roving bobbin replacement is performed manually. However, in spinning machines where an automatic apparatus is utilized for roving bobbin replacement, creels of this type are problematic in that the holder elements which support the roving bobbins cannot be precisely arranged with respect to the spinning positions of the machine with sufficient accuracy for reliable operation of the automatic apparatus.

Italian Patent No. 617,283 discloses another form of conventional roving bobbin creel wherein ring-like mounting elements may be attached at varying locations along the upright stanchions for height adjustment purposes. Each ring-like mounting element includes an outwardly projecting lug or flange to which a forked end of a support element may be clamped by a screw or other fastener, this arrangement enabling the support element to be oriented to extend transversely outwardly with respect to the spinning machine in either a horizontal or upwardly inclined disposition. Elongate carrier elements are fastened at the downwardly facing side of the support elements by retaining elements on the support elements.

West German Auslegeschrift No. 1,098,419 discloses a roving bobbin creel wherein each roving bobbin is supported at both its upper and lower ends. Mounting rings are attached to upright stanchions of the creel, each ring having a pair of mounting flanges projecting outwardly in a fork-like manner. Support elements are provided with a flat mounting end configured for receipt between the forked flanges for attachment of the support elements thereto by fastening screws. Longitudinal carrier elements are attached to the bottom of the support elements by retaining brackets, each carrier element being configured to define a slot in its downwardly-facing side to receive bobbin holder elements.

SUMMARY OF THE INVENTION

It is an object of the present invention to provide a novel roving bobbin creel of the basic aforementioned type which incapable of simple and easy assembly while also enabling bobbin holder elements to be precisely aligned with respect to the individual spinning positions of an associated spinning machine and, in turn, with respect to an automatic bobbin exchange apparatus or automatic traveling service unit associated with the spinning machine.

Briefly summarized, the roving bobbin creel of the present invention includes a plurality of upright stanchions arranged in spaced relation along the length of the spinning machine at the transverse center thereof, mounting elements affixed to the upright stanchions, support elements affixed to the mounting elements to extend therefrom transversely outwardly with respect to the spinning machine, and an elongate carrier element affixed to the support elements to extend longitudinally with respect to the spinning machine for supporting a plurality of roving bobbins. According to the present invention, each mounting element includes a tongue portion projecting transversely outwardly with respect to the spinning machine and each support element defines an interior receiving area for insertion of one tongue portion to affix the support elements on the mounting elements.

As a result of this construction, the support elements are precisely aligned and positioned by the tongue portions of the mounting elements, stabilizing the support elements and enabling their precise alignment and positioning with respect to the spinning positions of the spinning machine. Deformations of the support elements due to loading is largely avoided, even in the case of widely varying loads. The holder elements for the roving bobbins therefore can be reliably maintained in proper alignment with respect to an automatic roving bobbin replacement apparatus.

Preferably, the elongate carrier elements are supported at the underside of the support elements by retaining elements affixed to the support elements. As a result, the bobbin holder elements may be attached to the carrier elements in the immediate vicinity of the support elements for supporting the bobbins in depending fashion in proper alignment to the spinning positions without obstruction by the support elements. Moreover, the elongate carrier elements can be configured as tracks to accept movable carriage assemblies to which the roving bobbin holder elements are attached, enabling an automatic roving bobbin supply to the spinning positions.

In the preferred embodiment, each mounting element includes a pair of mating components configured to receive one stanchion therebetween to affix the mounting element to the stanchion. Mounting elements of this design are very stable and also offer the advantage of being attachable at any position along the vertical length of the stanchion for infinite adjustment of the elevation of the mounting elements. The mating components may be manufactured of an identical configuration, such as by an aluminum die casting process.

In one embodiment, the tongue portions of the mounting elements may be oriented to extend at an upward incline transversely outwardly of the spinning machine, thereby to correspondingly orient the support elements affixed thereto. In this manner, inner and outer rows of roving bobbins may be supported on the elongate carrier element with the outermost row of bobbins being at a greater elevation to provide increased head room for a spinning machine operator. Additionally, all roving bobbins of each row are visible to the operator since the inner row is not obscured by the more elevated outer row. The stability of the assembly of the mounting and support elements provided by the present invention further enables separate carrier elements for the inner and outer rows of bobbins to be attached to the same support elements.

The retaining elements by which the elongate carrier element is affixed to the support elements are preferably constructed as clamps for gripping engagement of one or both of the support elements and the elongate carrier element, enabling the elongate carrier element to be precisely aligned on the support elements both longitudinally and transversely with respect to the spinning machine. The elongate carrier element is preferably configured to define a longitudinal slot along its underside, the clamps being compatibly configured for gripping engagement of the carrier element without obstructing its longitudinal slot, enabling the roving bobbin holder elements to be positioned at any desired disposition along the elongate carrier element and to be readily moved therealong.

Each retaining element is also configured to receive and support respective ends of a pair of elongate carrier elements in end-to-end disposition. Accordingly, elongate carrier elements comprising multiple element sections may be utilized and inaccuracies in the spacing of the sections of the elongate carrier elements may be compensated within the retaining elements.

Each stanchion may include a pair of upright posts arranged in parallel relation to one another at a spacing transversely with respect to the spinning machine. Accordingly, the mating components of each mounting element are configured to cooperatively define a pair of receiving areas for the two posts, with each mating component further including a web portion extending between the receiving areas for accepting a fastener to clampingly retain the mating components in mating relation. Each mounting element may further include a slot for receiving an end portion of a support element for additional stability.

DESCRIPTION OF THE PREFERRED EMBODIMENT

Figure 1:
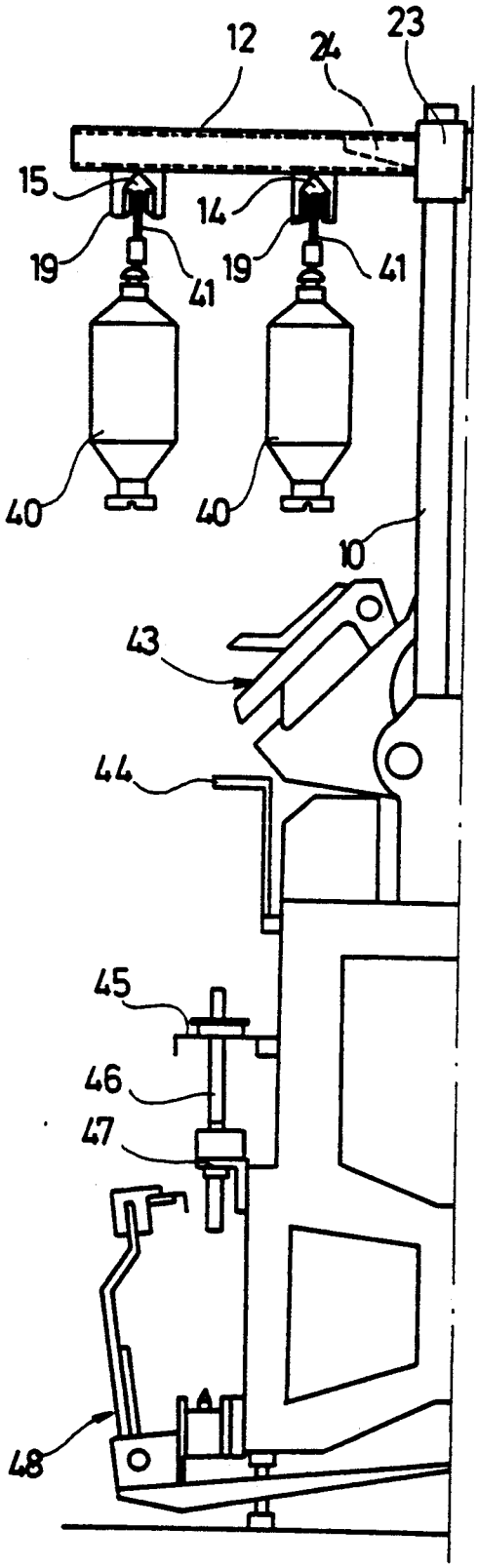
FIG. 1 is a schematic view in vertical cross-section of a ring spinning machine, only one side of which is shown, wherein the roving bobbin creel of the present invention is embodied.
Figure 2:
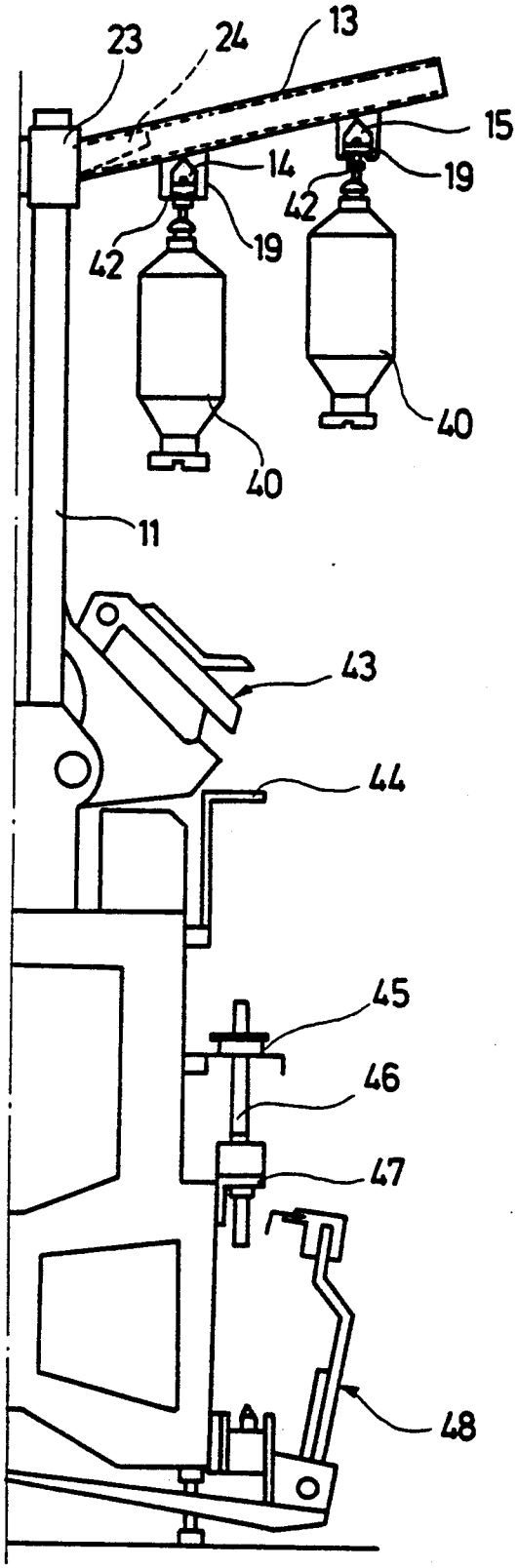
FIG. 2 is a schematic vertical cross-section of one side of a ring spinning machine similar to FIG. 1, illustrating an alternative embodiment of the present roving bobbin creel.

Referring now to the accompanying drawings, FIGS. 1 and 2 schematically illustrate a textile ring spinning machine of the basic type in which a roving bobbin creel according to the present invention is incorporated. Such ring spinning machines typically are constructed as so-called two-sided machines, i.e., the machines having an elongate frame at each opposite longitudinal side of which is provided a series of individual spinning positions. In FIGS. 1 and 2, only one side of each machine is illustrated, it being understood that the opposite side of the machine would be of a mirror image construction.

In such ring spinning machines, a roving is drawn at each spinning position from roving bobbins 40 supported on the creel downwardly into a drafting system 43 which drafts the roving into the desired yarn count. The drafted yarn is centered by guide elements 44 and delivered to a traveler element on a circular ring supported on a ring rail 45 from which the yarn is wound onto a yarn tube 46 supported centrally within the ring on a driven spindle which is mounted in a spindle bearing plate 47. Throughout this spinning operation, the ring rail 45 moves upwardly and downwardly along the yarn tube 46 to wind the yarn along the length of the tube 46. The spinning machines also include automatic tube replacement mechanisms 48, which may be of conventional construction.

In the embodiments of each of FIGS. 1 and 2, the roving bobbin creel basically includes a plurality of upright stanchions 10, 11 arranged in spaced relation along the length of the spinning machine in the longitudinal central plane of the machine, i.e. at the transverse center of the machine. Preferably, each stanchion is formed by a pair of upright posts 10, 11, arranged in parallel relation to one another at a spacing transversely with respect to the spinning machine (see FIG. 3). A mounting element 23 is affixed to each upright stanchion 10, 11 and a support element 12, 13 is affixed to each mounting element 23 to extend therefrom transversely outwardly with respect to the spinning machine. Retaining elements 19 are affixed at spacings to one another at the underside of each support element 12,13 and elongate carrier elements 14, 15 are respectively supported by the retaining elements 19 to extend longitudinally along the spinning machine. Each elongate carrier element 14, 15 carries a plurality of holder elements 41, 42 by which the roving bobbins 40 are supported from the carrier elements 14, 15 in a depending fashion for delivery of roving to the spinning positions of the machine as above-described.

In the embodiment of FIG. 1, the roving bobbin holder elements 41 are designed as carriage assemblies movable along the length of the elongate carrier elements 14, 15. The elongate carrier elements 14, 15 are configured in a so-called roof-like profile having a pentagonal cross-section the lower side of which is formed with an elongated slot 22 (see FIGS. 3 and 4). The bobbin holder elements 41 travel along the web portions of the carrier elements 14, 15 defining the opposite longitudinal sides of the slot 22, whereby the bobbins 40 can be precisely aligned and positioned with respect to the individual spinning positions of the machine. As will be understood by those persons skilled in the art, proper alignment between the bobbins 40 and the spinning positions of the machine is necessary to enable an automatic traveling service unit to properly service the spinning position. For example, an automatic roving joining or splicing apparatus must be able to locate and grasp the leading end of a roving from a roving bobbin 40 supported above a spinning position in order to join it with the trailing end of roving extending from the drafting system 43 of the associated spinning position.

The construction and operation of the retaining elements 19 by which the elongate carrier elements 14, 15 are supported at the underside of the support elements 12 are discussed hereinafter. However, as will be noted, the retaining elements 19 do not obstruct the elongate slot 22 in the carrier elements 14, 15, enabling the bobbin holder elements 41 to move along the carrier elements 14, 15 without restriction. Since the elongate carrier elements 14, 15 are supported at the underside of the support elements 12, the support elements 12 also present no obstacle to movement of the bobbin holder elements 41.

In the embodiment of FIG. 1, the support elements 12 extend horizontally outwardly from the upright stanchions 10, 11. However, in the alternate embodiment of FIG. 2 the support elements 13 are affixed to the mounting elements 23 to extend transversely outwardly from the spinning machine at a slight upward incline. In this manner, the two rows of roving bobbins 40 respectively supported on the elongate carrier elements 14, 15 are disposed at differing elevations. Accordingly, the head room above the spinning positions available for a spinning machine operator is increased. Additionally, the outermost row of roving bobbins 40 supported by the carrier element 15 does not completely obscure the inner row of bobbins 40 supported by the carrier element 14, enabling the machine operator to obtain better visibility of all of the roving bobbins 40.

In each of the embodiments of the present creel in FIGS. 1 and 2, the mounting elements 23 include tongue portions 24 projecting transversely outwardly with respect to the spinning machine at each opposite side of the mounting elements 23. The support elements 12, 13 are of a profiled configuration, e.g., of a roof-type profile like that of the elongate carrier elements 14, 15 as described above, defining an interior area for inserted receipt therein of one of the tongue portions 24. In the embodiment of FIG. 1, the tongue portions 24 extend horizontally outwardly from the mounting elements 23 so that the support elements 12 are correspondingly oriented horizontally when mounted thereon. In the embodiment of FIG. 2, the tongue portions 24 extend at an upward incline from the mounting elements 23 to correspondingly orient the support elements 13 at an upward incline as above-described. The inclination of the tongue portions 24 and the support elements 13 is preferably in the range of approximately 15 degrees from horizontal, to achieve the differing elevations of the front and back rows of bobbins 40 as also above-described.

In the embodiment of the present creel shown in FIG. 2, the bobbin holder elements 42 are fastened in a stationary manner to the elongate carrier elements 14, 15, rather than being movable as with the bobbin holder elements 41 of FIG. 1. Each bobbin holder element 42 is affixed to the respective carrier element 14, 15 in a position therealong precisely oriented relative to a particular associated spinning position and relative to an automatic traveling service unit associated with the spinning machine for performing replacement operations on the roving bobbins 40. Traveling service apparatus of this type are capable of exchanging a full roving bobbin for a depleted roving bobbin 40 both at the outer row of bobbins 40 as well as at the inner row of bobbins 40. As necessary or desirable, such traveling service apparatus can also be capable of automatically introducing the leading end of roving from the full replacement bobbin 40 into the drafting system 43 of the associated spinning position. As will be understood, since the elongate carrier elements 14, 15 are attached to the bottom of the support members 13, the support members 13 present no obstacle to the alignment and adjustment of the relative positioning of the bobbin holder elements 42 along the carrier elements 14, 15.

Figure 3:
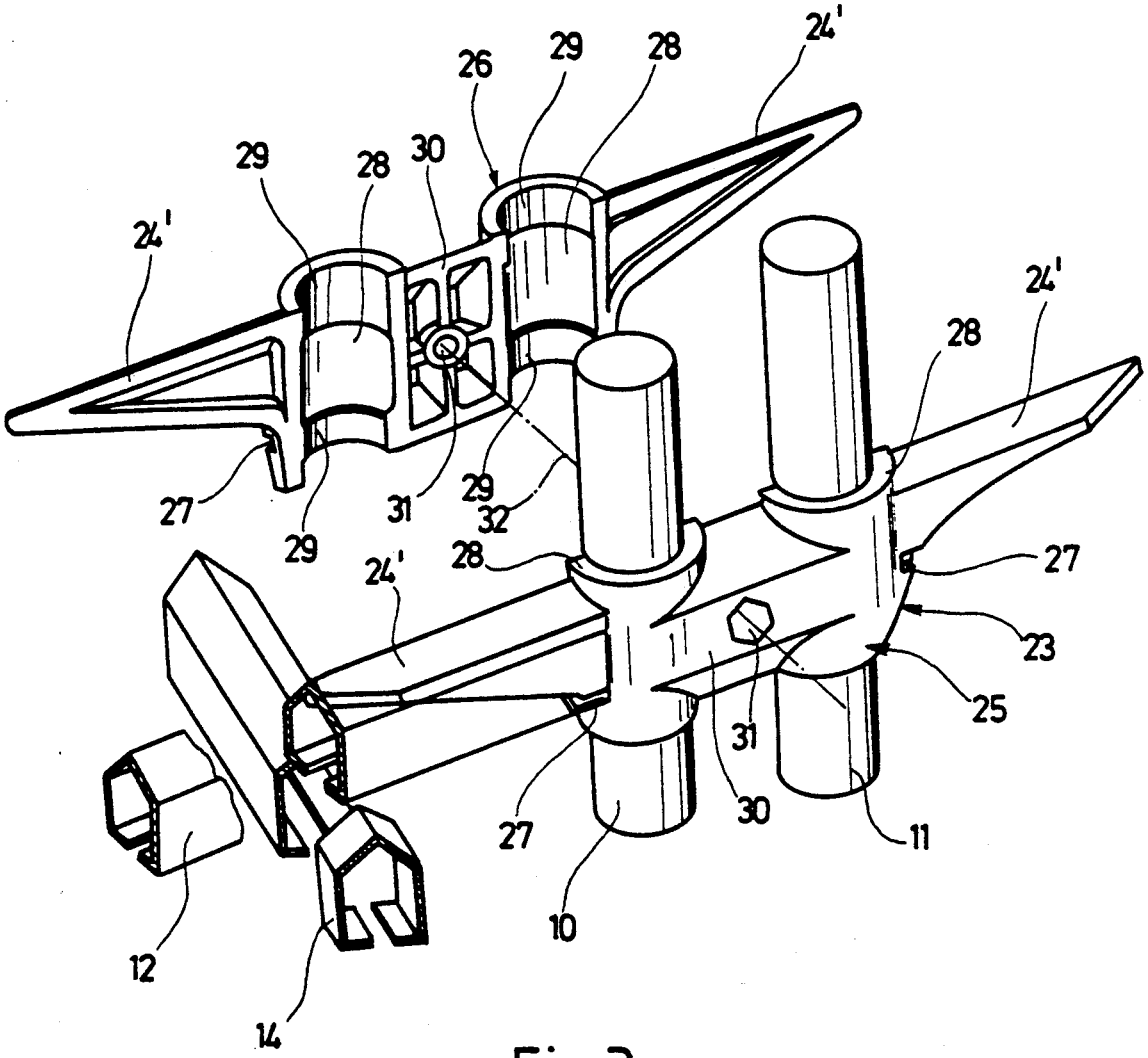
FIG. 3 is a partially exploded view of a mounting element, a support element, and an elongate carrier element of the roving bobbin creel of the present invention.

In FIG. 3, one of the mounting elements 23 is illustrated on an enlarged scale as preferably attached to one of the upright stanchions formed by a pair of upright posts 10, 11. As previously described, the mounting element 23 includes a pair of tongue portions 24 projecting outwardly from the stanchion at opposite sides of the mounting element 23. As shown in FIG. 3, the mounting element 23 is representative of the embodiment shown in FIG. 1, with the projecting tongue portions 24 extending horizontally for mounting of the support elements 12 in a horizontal disposition. Of course, as will be understood, essentially the only modification to the carrier element 23 of FIG. 3 to produce a carrier element 23 of the embodiment of FIG. 2 would be to orient the projecting tongue portions 24 at the desired upward incline relative to the main body of the carrier element 23. Accordingly, such a carrier element 23 according to the embodiment of FIG. 2 is not separately illustrated.

Each carrier element 23, whether of the embodiment of FIGS. 1 or 2, consists of a pair of mating components 25, 26, preferably of identical configuration. It is further preferred that the mating components 25, 26 be manufactured from aluminum die castings. Each of the mating components 25, 26 includes a pair of semi-cylindrical or otherwise uniform prismatic mounting portions 28 terminating at their respective upper and lower sides by collar portions 29, the semi-cylindrical shape and form of the mounting and collar portions 28, 29 conforming to the cylindrical shape and size of the upright stanchion posts 10, 11 for secure engagement therewith. The mounting and collar portions 28, 29 of each mating component 25, 26 are connected to one another by a web portion 30 formed centrally with a bore 31 for receiving a clamping screw indicated in FIG. 3 only by the dotted line 32. The bore 31 of each component 25, 26 is formed of a stepped diameter which is hexagonal at the outer surface of the component 25, 26 to accept a hexagonal nut or screw head and of a reduced diameter circular shape at the inward face of the component 25, 26 to receive a screw shaft. In this manner, the two mating components 25, 26 of each mounting element 23, when brought together in facing mirror image relation, cooperatively define a pair of receiving areas for the upright stanchion posts 10, 11, the respective bores 31 of the mating components 25, 26 aligning with one another to accept the clamping screw 32 to clampingly engage the posts 10, 11 between the mating components 25, 26 for mounting them on the posts.

The web portion 30 of each mating component 25, 26 is provided with an inclined surface at its upper side so that the inclined surfaces of the web portions 30, when assembled, present a roof-type profile like that of the support elements 12, 13 and the elongate carrier elements 14, 15. Accordingly, large deposits of dirt, fly, lint or the like on the mounting elements 23 are prevented. For aesthetic reasons, the bottom side of the web portions 30 of each mating component 25, 26 is correspondingly inclined. A one-half tongue portion 24, extends outwardly from each mounting portion 28 to cooperate with a mating one-half tongue portion 24' of the other mating component 25, 26 when the components are joined together as aforedescribed. Each one-half tongue portion 24' has an inclined upper surface so that each complete tongue portion 24 formed by assembly of the mating components 25, 26 has a roof-type profile and contour conforming to that of the support elements 12, 13. The bottom side of each one-half tongue portion 24' extends obliquely relative to the upper inclined surface in relation to the anticipated loading of the tongue portions 24 of the mounting elements 23. Further, the oblique configuration of the bottom surface of the tongue portions 24 makes it possible to mount the retaining elements 19 to the underside of the support elements 12, 13 at a relatively close disposition to the stanchion posts 10, 11 (see FIG. 4).

The tongue portions 24 of each mounting element 23 are formed with slots 27 in the region adjacent to the mounting portions 28 for receiving in the slots 27 the web portions of the support elements 12, 13 bordering the opposite sides of the elongate slot in the underside of support elements 12, 13, thereby to rigidify and stabilize the mounted disposition of the support elements 12, 13 on the tongue portions 24. As a result, the mounting assembly of the support elements 12, 13 on the tongue portions 24 of the mounting elements 23 is easily accomplished simply by inserting the tongue portions 24 into the interior receiving area of the support elements 12, 13. In embodiments such as FIG. 2 wherein the support elements 12, 13 extend at an upward incline from the mounting elements 23, the insertion of the tongue portions 24 into the support elements 12, 13 provides a sufficient assembly in itself, without additional securement necessary. In an embodiment such as FIG. 1 wherein the support elements 12 extend horizontally, it may be desirable to provide additional securing elements to retain the support elements 12 in mounted assembly on the mounting elements 23.

Figure 4:
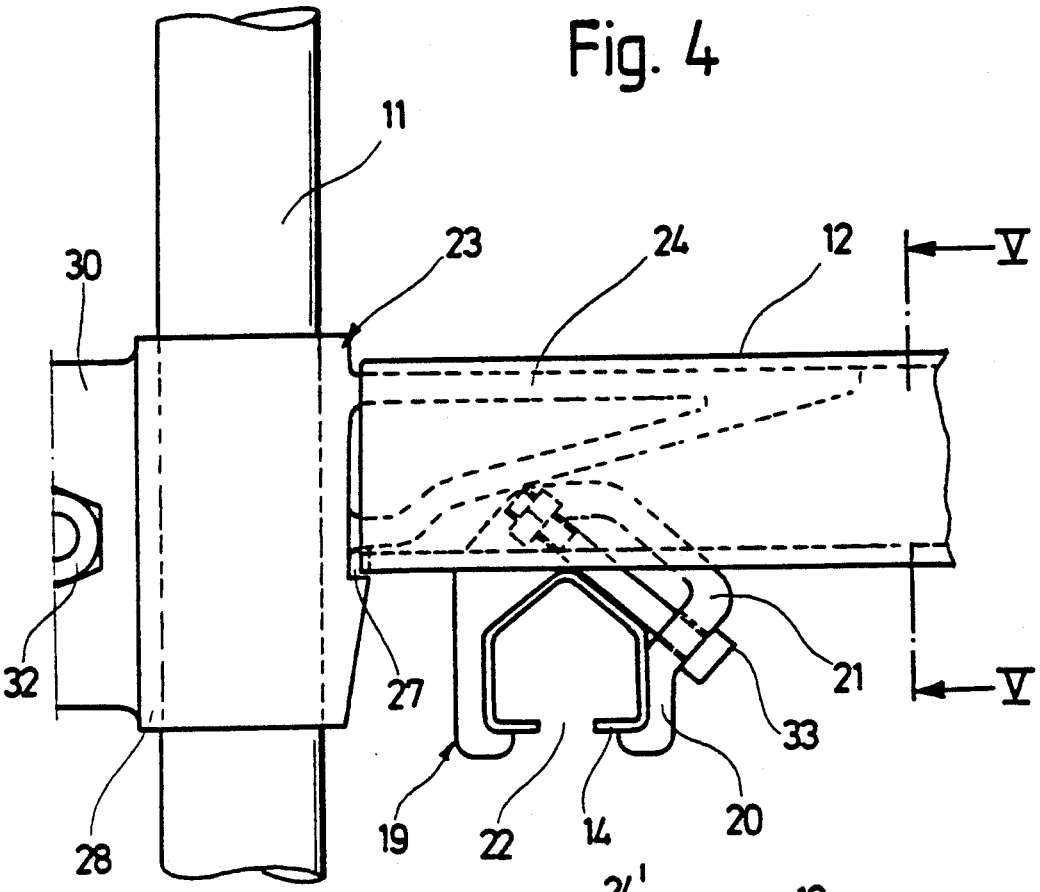
FIG. 4 is a partial side elevational view of the present roving bobbin creel in the area of attachment between one mounting element and one support element of the creel.
Figure 5:
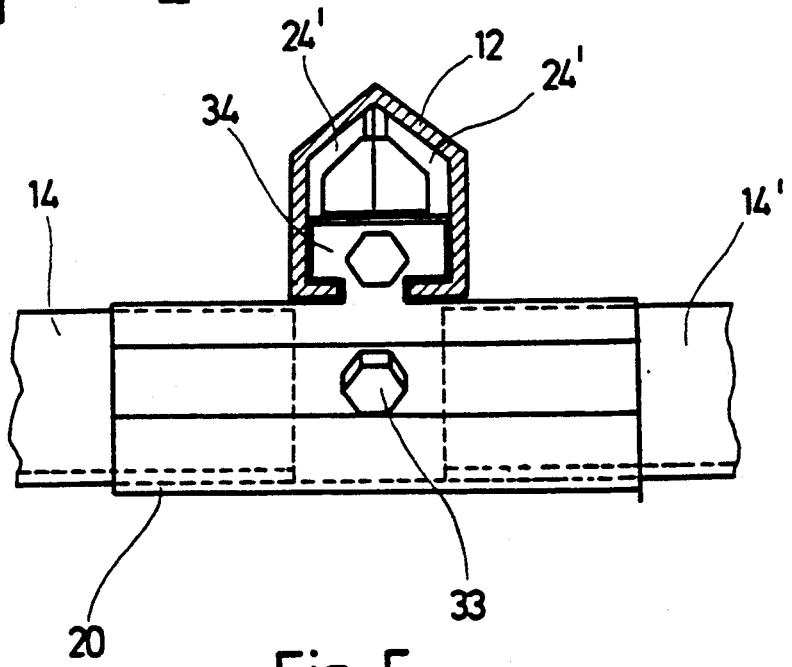
FIG. 5 is a vertical cross-sectional view taken along line V—V of FIG. 4.

The aforementioned mounting of the elongate carrier elements 14, 15 to the underside of the support elements 12, 13 by means of the retaining elements 19 is shown in greater detail in FIGS. 4 and 5. Each retaining element 19 includes two spaced clamping webs 20 configured in conformity to the exterior profile of the elongate carrier elements 14, 15 to receive the carrier elements 14, 15 between the clamping webs 20 while leaving open and unobstructed the elongate longitudinal slot 22 extending along the underside of the carrier elements 14, 15. The clamping webs are connected by an intermediately extending web 21 which is formed with areas of increased cross-sectional thickness configured in a hammerhead shape as at 34 defining opposed recesses by which the hammerhead portion 34 of the web 21 may be received within the interior of a support element 12 through the elongated slot in its underside. A clamping bolt 33 extends through the retaining element 19 at a spacing from the connecting web 21 in the direction of the clamping webs 20 for selective tightening the clamping webs into gripping engagement with elongate carrier elements 14, 15 received therebetween and for also tightening the hammerhead portion with respect to the support elements 12, 13. As will thus be understood, the retaining elements 19 thus enable the elongate carrier elements 14, 15 to be adjustably positioned both longitudinally with respect to the spinning machine as well as transversely with respect thereto by shifting movement along the support elements 12, 13 and enable the elongate carrier elements 14, 15 to be fixed in any desired disposition by tightening of the clamping bolt 33, whereby an exact adjustment and alignment of the carrier elements 14, 15 is possible.

As will also be recognized from FIG. 5, the receiving portion of the retaining element 19 defined by the spaced clamping webs 20 is of a sufficient elongated configuration extending longitudinally with respect to the spinning machine for receiving the end portions of two sections of carrier elements 14, 15, such as represented by the carrier elements 14, 14' in FIG. 5. As such, the retaining elements 19 make it possible to compensate for variations in length of individual sections of the elongate carrier elements. As will be understood, it is logical and desirable in an embodiment of the present creels such as represented in FIG. 1 to arrange the individual sections of the elongate carrier elements 14, 15 in end-to-end abutment to facilitate the movability of the carriage assemblies utilized as the bobbin holder elements 41. On the other hand, in embodiments of the creel such as represented in FIG. 2 wherein each bobbin holder element 42 is affixed in place to the elongate carrier elements 14, 15, spacings can be left between the adjacent ends of the carrier elements 14, 15. In either case, the retaining elements 19 serve not only to longitudinally align the individual sections of the carrier elements 14, 15 but also to dispose the individual sections of the carrier elements 14, 15 at uniform transverse orientations relative to the associated spinning machine.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a textile ring spinning machine or the like, a roving bobbin creel comprising a plurality of upright stanchions arranged in spaced relation along the length of the spinning machine at the transverse center of the spinning machine, mounting elements affixed to the upright stanchions, support elements affixed to the mounting elements to extend therefrom transversely outwardly with respect to the spinning machine, and an elongate carrier element affixed to said support elements to extend longitudinally with respect to said spinning machine for supporting a plurality of roving bobbins, each mounting element including a tongue portion projecting transversely outwardly with respect to the spinning machine and each support element defining an interior receiving area for insertion of one tongue portion to affix the support elements on the mounting elements.

2. A roving bobbin creel according to claim 1 and characterized further in that each mounting element comprises a pair of mating components configured to receive one stanchion therebetween to affix the mounting element to the stanchion.

3. A roving bobbin creel according to claim 2 and characterized further in that the mating components are identically configured.

4. A roving bobbin creel according to claim 1 and characterized further in that the tongue portion of each mounting element and the support elements affixed thereto extend at an upward incline transversely outwardly of the spinning machine.

5. A roving bobbin creel according to claim 1 and characterized further in that each mounting element comprises a slot for receiving an end portion of a support element.

6. A roving bobbin creel according to claim 2 and characterized further in that each stanchion comprises a pair of upright posts arranged in parallel relation to one another at a spacing transversely with respect to the spinning machine, and the mating components of each mounting element cooperatively define a pair of receiving areas for the posts, each mating component including a web portion extending between the receiving areas for accepting a fastener to clampingly retain the mating components in mating relation.

7. A roving bobbin creel according to claim 1 and characterized further by retaining elements affixed to the support elements for supporting the elongate carrier element at the underside of the support elements.

8. A roving bobbin creel according to claim 7 and characterized further in that the retaining elements comprise clamps for gripping engagement of at least one of the support elements and the elongate carrier element.

9. A roving bobbin creel according to claim 8 and characterized further in that the elongate carrier element is configured to define a longitudinal slot along its underside, the clamps being compatibly configured for gripping engagement of the elongate carrier element without obstructing its longitudinal slot.

10. A roving bobbin creel according to claim 7 and characterized further in that each retaining element is configured to receive and support respective ends of a pair of elongate carrier elements.

* * * * *